US006415893B1

(12) United States Patent
de Jong

(10) Patent No.: US 6,415,893 B1
(45) Date of Patent: Jul. 9, 2002

(54) ARRANGEMENT FOR GUIDING A CAR CABLE

(75) Inventor: Johannes de Jong, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/708,501

(22) Filed: Nov. 9, 2000

(30) Foreign Application Priority Data

May 12, 1998 (FI) ..... 981053

(51) Int. Cl.[7] ..... B66B 7/06

(52) U.S. Cl. ..... 187/414; 187/441; 187/413

(58) Field of Search ..... 187/411, 413, 187/414

(56) References Cited

U.S. PATENT DOCUMENTS

| | | |
|---|---|---|
| 1,810,960 A | 6/1931 | Hall |
| 5,103,937 A | 4/1992 | Robertson |

FOREIGN PATENT DOCUMENTS

| | | |
|---|---|---|
| JP | 1299182 | 1/1989 |
| JP | 313478 | 1/1991 |

*Primary Examiner*—Steven A. Bratlie
(74) *Attorney, Agent, or Firm*—Birch, Stewart, Kolasch & Birch, LLP

(57) ABSTRACT

Arrangement for guiding a car cable has one end of the car cable attached to the elevator car while the other end is attached to a connection point in the elevator shaft. The car cable forms a loop hanging below its points of attachment. The arrangement comprises at least one cable holder. The cable portion between the attachment point and the lowest point of the cable loop can be held by the cable holder so as to limit the lateral motion of the cable.

14 Claims, 2 Drawing Sheets

ARRANGEMENT FOR GUIDING A CAR CABLE

This application is a Continuation of PCT International Application No. PCT/F199/00409 filed on May 12, 1999, which designated the United States and on which priority is claimed under 35 U.S.C. § 120, the entire contents of which are hereby incorporated by reference.

1. Field of the Invention

The present invention relates to an arrangement for guiding the car cable of an elevator.

2. Description of the Related Art

An elevator car is connected to the outside space via a car cable, which is used for the supply of electricity to the elevator car and transmission of data between the car signal equipment, such as display devices and call buttons, and the elevator control system. One end of the car cable is attached to a suitable place in the elevator shaft and the other is connected to the bottom of the elevator car or car frame. The car cable hangs in the elevator shaft either freely or, in taller buildings, loaded with a tensioning weight.

In high-rise buildings, the elevator shaft may be hundreds of meters long, so the car cable may have a length of tens of meters and it tends to swing in spite of the tensioning weight. In a tall building, swinging is generated by the movements of the elevator and the resulting air currents and by the sway of the building. In elevators mounted in ships, the elevator shaft is not always upright due to the pitching and rolling motion of the ship, which causes swinging of the car cable. In elevators mounted on the outside of a building, the elevator shaft is partly exposed to ambient conditions, permitting the wind to seize the relatively light car cable.

A swinging car cable may get stuck on structural parts of the elevator shaft or it may hit the shaft walls, resulting in damage to the cable or possibly even to shaft equipment. A swinging car cable hitting other objects also generates unpleasant noise.

Finnish patent FI C 91740 presents an apparatus in which the car cable is held fast on a shaft wall by using pressurised air. However, this solution requires a car cable suited for the purpose and special pneumatic equipment in the elevator shaft along the whole length of the cable. The solution is expensive and difficult to maintain.

BRIEF SUMMARY OF THE INVENTION

The object of the present invention is to produce an advantageous solution to the problem described above and to develop a car cable guide apparatus which reliably prevents excessive cable car swing.

In the solution of the invention, the free portion of the car cable, i.e. the portion between the elevator car and the fixed attachment point, is tied to at least one cable holder, thus preventing lateral swing of the cable. The car cable is automatically engaged and released by the holders as the cable loop below the car is ascending or descending in the shaft. The engagement and release of the cable is preferably achieved by using a tensioning weight system comprised in the cable equipment.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail by the aid of a preferred embodiment by referring to the attached drawings which are given by way of illustration only, and thus are not limitative of the present invention, and wherein.

DETAILED DESCRIPTION OF THE INVENTION

Figure 1:
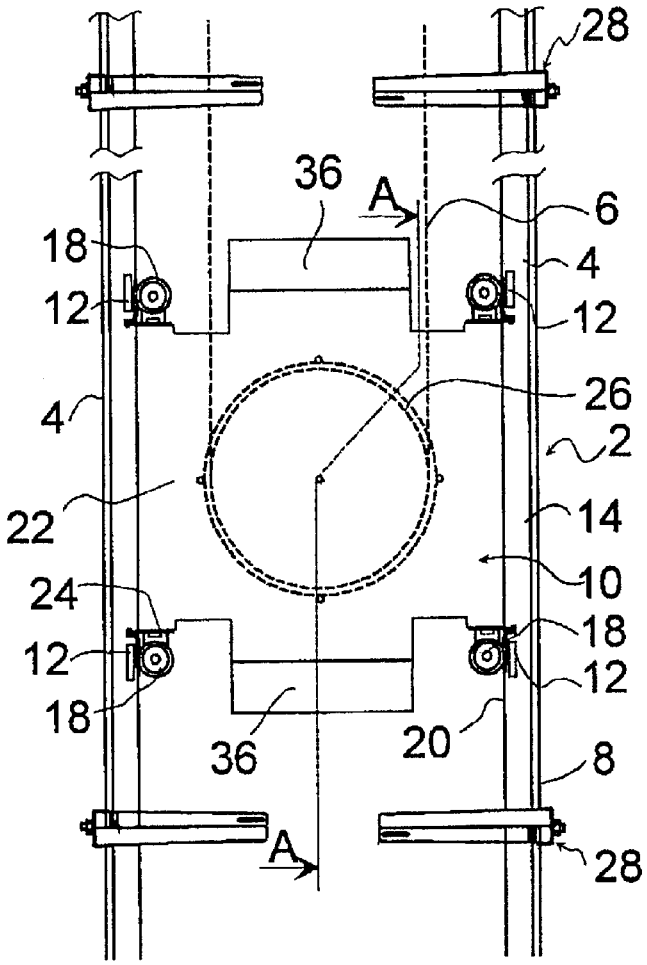
FIG. 1 presents the arrangement of the invention in front view.
Figure 3:
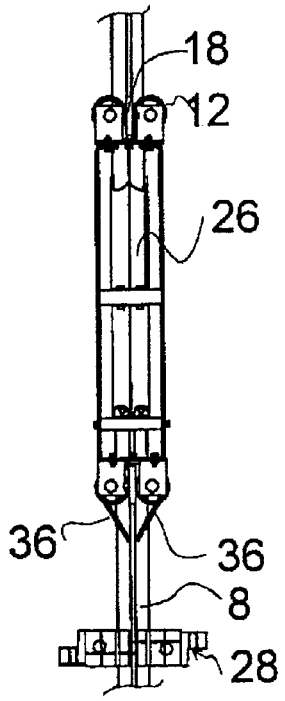
FIG. 3 presents the arrangement of the invention in side view, section A—A in FIG. 1.
Figure 2:
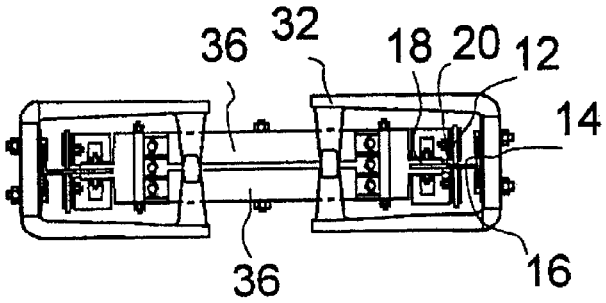
FIG. 2 presents the arrangement of the invention in top view.

FIGS. 1, 2 and 3 illustrate a car cable guide apparatus according to the invention, mounted in an elevator shaft 2. One end of the car cable 6 is attached to the elevator car (not shown) and the other end is attached to a connection point (not shown) located in the elevator shaft midway between the ends of the shaft or higher. The car cable hangs between its attachment points as a loop whose lowest point moves as the elevator car is moving. Placed in the elevator shaft 2 are cable guide bars 4 extending through a distance corresponding to the length of the car cable 6 starting from the bottom of the shaft 2. The guide bars 4 are T-shaped bars attached to the shaft by their bases 8 by means of guide bar holders (not shown) placed at suitable distances. The sides of the stem of the guide bar 4 form guide surfaces 14 and 16 for guide rollers 12. Guide roller 18 runs along the edge 20 of the stem. As seen from the front (FIG. 1), the carriage 10 for the tensioning weight comprises a rectangular frame 22, the guide rollers 12, 14 and 18 being rotatably mounted at each corner 24 of the frame. Also rotatably mounted on the frame 22 is a diverting pulley 26, the car cable 6 being arranged to pass under it. When the elevator car is moving in the shaft, the tensioning weight carriage 10 moves along the guide bars 4 while the car cable loop 6 below the elevator car is ascending and descending.

Figure 4:
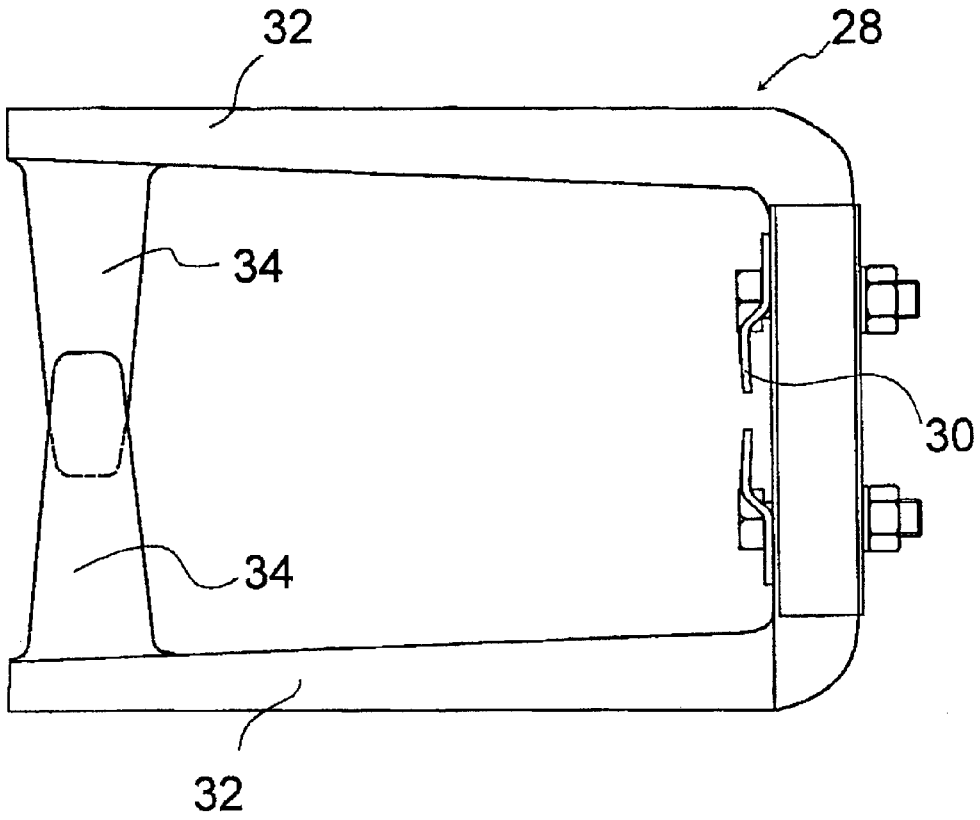
FIG. 4 presents a car cable-holder in top view.
Figure 5:
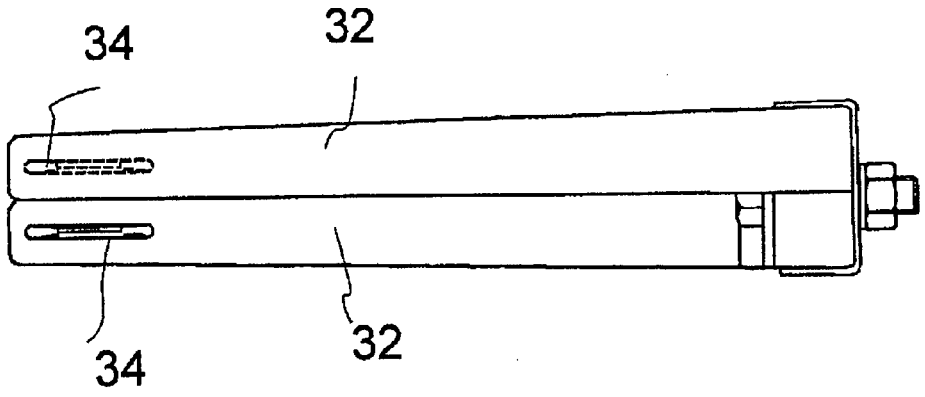
FIG. 5 presents a car cable holder in side view.

Cable holders 28 are attached to the guide bars 4 at suitable distances by means of attachment brackets 30 engaging the guide bar by its base 8. The cable holders 28 are U-shaped elements (FIGS. 2 and 4) placed so that their prongs or holding arms 32 point toward the tensioning weight carriage 10. On each guide bar, the cable holders 28 are preferably at, the same height. The prongs 32 extend laterally insider the car cable loop and, the part of the prongs 32 extending, inside the loop is provided with flexible vanes 34 acting as a gate which closes the cable holder 28. The car cable is held in the space enclosed by the prongs 32 and the vanes 34, the lateral motion of the cable being thus limited. The vanes on the prongs of each cable holder 28 extend somewhat beyond halfway across the U-gap, so they partially overlap each other. As shown in FIG. 5, the vanes are disposed at slightly different vertical levels. The vanes are placed close enough to each other to effectively prevent the car cable from slipping out of the holder but so as not to touch each other, so they produce no noise when closing.

Formed in the upper and lower parts of the tensioning weight carriage 10 are control elements 36 for opening the vanes 34. The frame 22 of the carriage consists of two plates with their upper and lower edges bent toward each other to form opening elements 36. The opening elements are of a width smaller than that of the car cable loop but larger than the distance between the vanes 34 of the opposite cable holders. When the tensioning weight carriage is passing through the cable holder, the opening elements 36 move the vanes 34 aside, and after the carriage has passed through the holder, the vanes return to their normal position. The car cable above the tensioning weight carriage 10 is now within the cable, holders 28 and the cable can only swing within the space limited by the holder and its vanes.

The invention has been described above by referring to one of its embodiments. However, the presentation is not to be regarded as a limitation of the scope of patent protection, but the embodiments may vary within the limits defined by the claims. The cable holders can be shaped in many alternative ways. It is possible to have the tensioning weight guided by the cable holders, making the guide bars and guide rollers unnecessary. In this case, the number of cable holders must be adjusted accordingly.

What is claimed is:

1. An arrangement for guiding a car cable, one end of the car cable being attached to an elevator car and another end of the car cable being attached to a connection point in an elevator shaft, the car cable forming a loop hanging below points of attachment therefor, the arrangement comprising at least one cable holder and a tensioning weight, the tensioning weight being fitted in the car cable loop, the car cable being held by the cable holder so as to limit lateral motion of the car cable, the cable holder being openable by the tensioning weight as the tensioning weight passes the cable holder.

2. The arrangement as defined in claim 1, wherein the cable holder is openable and closeable in synchronism with movement of the car cable and the tensioning weight being at a lowest point of the car loop.

3. The arrangement as defined in claim 1, wherein the tensioning weight is movable along guide bars provided in the elevator shaft, the cable holders being mounted on the cable bars, the cable holder being opened by the tensioning weight as the tensioning weight passes the cable holder.

4. The arrangement as defined in claim 1, wherein the tensioning weight is movable along guide bars provided in the elevator shaft and wherein the at least one cable holder comprises a plurality of cable holders which are attached to the guide bars, the cable holders being on both sides of the car cable.

5. The arrangement as defined in claim 1, wherein the at least one cable holder comprises a plurality of cable holders and wherein a pair of guide bars are provided, the cable holders are positioned on both pairs of the guide bars.

6. The arrangement as defined in claim 5, wherein the tensioning weight is vertically movable along the pair of guide bars.

7. The arrangement as defined in claim 1, wherein the tensioning weight comprises a diverting pulley and a carriage, the car cable passing under the diverting pulley and the carriage having guide rollers, the tensioning weight being movable along guide bars provided in the elevator shaft, the guide rollers keeping the carriage on the guide bars.

8. The arrangement as defined in claim 1, wherein the at least one cable holder compress holding arms and a closing device fitted between the holding arms, the closing device being opened when the tensioning weight passes the holder.

9. The arrangement as defined in claim 8, wherein upper and lower edges of the tensioning weight are provided with elements for opening the closing device.

10. The arrangement as defined in claim 8, wherein the cable holder has two closing devices extending toward each other and disposed at a displaced vertical level relative to one another.

11. The arrangement as defined in claim 8, wherein the cable holder has two closing devices extending toward each other and disposed at a displaced vertical level relative to one another.

12. The arrangement as defined in claim 8, wherein the upper and lower edges of the tensioning weight have elements which engage the closing device as the tensioning weight passes thereby in order to open the closing device, each of the elements form a point with adjacent sloped sides which cam the closing device to as open position, the closing device returning to a closed position after the tensioning weight passes.

13. The arrangement as defined in claim 8, wherein the tensioning weight is movable along guide bars provided in the elevator shaft and wherein the at least one cable holder comprises a plurality of cable holders which are attached to the guide bars, the cable holders being on both sides of the car cable.

14. The arrangement as defined in claim 8, wherein the at least one cable holder comprises a plurality of cable holders and wherein a pair of guide bars are provided, the cable holders are positioned on both pairs of the guide bars and the tensioning weight being located between the guide bars.

* * * * *